United States Patent [19]

Jönsson

[11] Patent Number: 4,803,607

[45] Date of Patent: Feb. 7, 1989

[54] SURGICAL OPERATING ROOM LAMP OR SIMILAR LAMP

[75] Inventor: Stig Jönsson, Blomstermåla, Sweden

[73] Assignee: Landstingens inkopscentral LIC, ekonomisk forening, Solna, Sweden

[21] Appl. No.: 143,554

[22] PCT Filed: May 20, 1987

[86] PCT No.: PCT/SE87/00251

§ 371 Date: Jan. 19, 1988

§ 102(e) Date: Jan. 19, 1988

[87] PCT Pub. No.: WO87/07354

PCT Pub. Date: Dec. 3, 1987

[30] Foreign Application Priority Data

May 20, 1986 [SE] Sweden ..... 8602278

[51] Int. Cl.[4] ..... F21V 11/14

[52] U.S. Cl. ..... 362/250; 362/233; 362/238; 362/240 804

[58] Field of Search ..... 362/233, 250, 237, 238, 362/240, 282, 285, 287, 289, 277, 283, 284, 418, 804, 404

[56] References Cited

U.S. PATENT DOCUMENTS

| | | | |
|---|---|---|---|
| 2,846,566 | 8/1958 | Günther et al. | 362/285 |
| 3,887,801 | 6/1975 | Ilzig et al. | 362/233 |
| 4,025,778 | 5/1977 | Hayakawa | 362/233 |
| 4,135,231 | 1/1979 | Fisher | 362/285 |
| 4,280,167 | 7/1981 | Ellett | 362/404 |
| 4,316,237 | 2/1982 | Yamada et al. | 362/804 |
| 4,390,929 | 6/1983 | La Fiandra | 362/289 |

FOREIGN PATENT DOCUMENTS

| | | | |
|---|---|---|---|
| 237748 | 1/1962 | Austria | 362/282 |
| 828574 | 7/1949 | Fed. Rep. of Germany | 362/804 |
| 485381 | 10/1953 | Italy | 362/804 |
| 927189 | 5/1963 | United Kingdom | 362/287 |

*Primary Examiner*—Ira S. Lazarus
*Assistant Examiner*—Sue Hagarman
*Attorney, Agent, or Firm*—Young & Thompson

[57] ABSTRACT

Surgical operating room lamp comprising a lamp housing (10) and at least three reflectors (24, 26, 28) with bulbs or similar lamps provided in the housing and equally spaced around the center optical axis of the lamp housing. According to the invention all reflectors are carried by a flexible diaphragm member (16) which rests at its edge against an abutment shoulder (14) in the housing. The center of the diaphragm member is axially movable by means of a control member (18, 20, 22) to be flexed so as to adjust the angular position of the reflectors simultaneously.

3 Claims, 2 Drawing Sheets

SURGICAL OPERATING ROOM LAMP OR SIMILAR LAMP

The present invention relates to a lamp to be used for surgical operations or for investigations of patients in hospitals. More particularly the lamp is of the kind comprising a lamp housing supporting at least three reflectors associated each with at least one bulb or similar lamp and being angularly adjustable to focus the light beams to a predetermined area along the central optical axis of the lamp housing, the reflectors being spaced equally around the optical axis.

In known lamp housings of this kind the reflectors are carried by individually adjustable holders to adjust the angular position of each reflector. To adjust the positions of the light beams each reflector must be adjusted individually which is time consuming, and further each holder comprises an extra design detail which increases the manufacturing costs.

The object of the invention is to enable a simultaneous angular adjustment of all holders by means of a single adjustment device.

This object is attained with a lamp which according to the invention has the characterizing features set forth in the appended main claim.

Basically, all reflectors are mounted in openings in a flexible diaphragm member which at its periphery is resting against a shoulder or similar abutment on the inside of the lamp housing and is biassed against this shoulder by means of an axially displaceable control device secured to the center of the diaphragm member. By displacing the center of the diaphragm member axially relative to the shoulder, the diaphragm member will be symmetrically bent so that those portions of the diaphragm member supporting the reflectors will simultaneously be set to the desired angular position.

A preferred embodiment of the lamp according to the invention is shown by way of example in the accompanying drawings.

Figure 1:
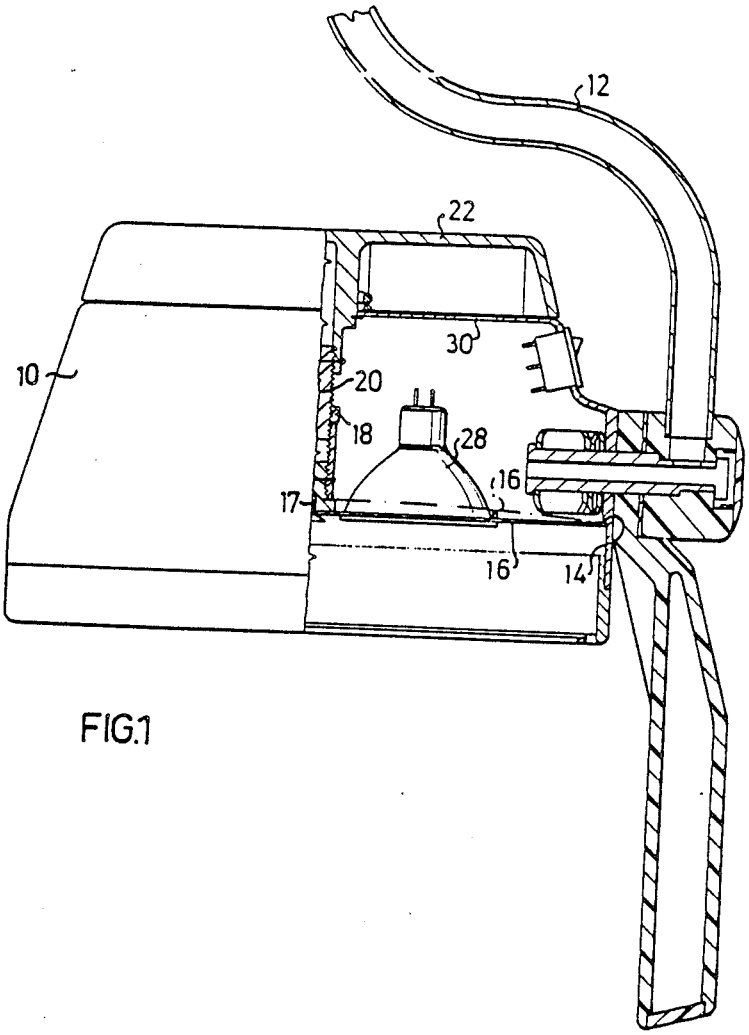
Figure 2:
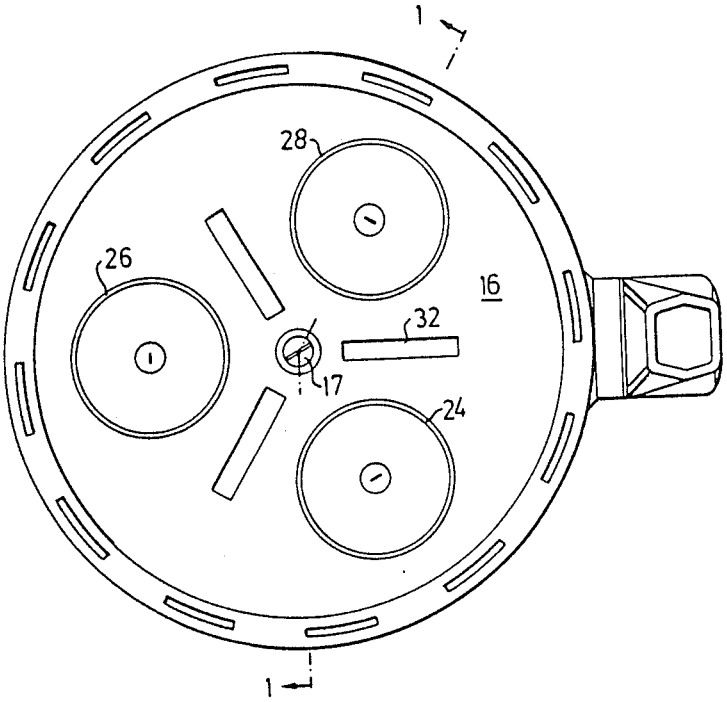

FIG. 1 is a partial section through the lamp according to the invention along line 1—1 in FIG. 2, and FIG. 2 is a plan view of the bottom end of the lamp.

The lamp has a lamp housing 10 carried by a holder 12.

On the inside of the lamp housing there is a circular shoulder 14 forming an abutment for the peripheral edge of a flexible diaphragm member 16 which may be of plastics. In the example shown the diaphragm member has a continuous circular edge cooperating with the circular shoulder, but the edge of the diaphragm member may be interrupted by recesses to provide ventilation openings.

To the center of the diaphragm member is secured a control device by means of a screw 17. The screw attaches a nut sleeve 18 to the diaphragm member. An adjustment screw 20 cooperates with the nut sleeve 18 and is secured to a rotatable control knob 22 provided at the upper end of the lamp housing 10.

If the knob 22 is rotated in a direction to move the center of the diaphragm member axially inwardly into the lamp housing, the diaphragm member will be symmetrically flexed to the position indicated by dotted lines.

Equally spaced around the center axis of the lamp housing or the center optical axis of the lamp are three openings in which are mounted reflectors 24,26,28, which are each associated with at least one bulb or other lamp to direct a light beam from each reflector. There may be provided more than three reflectors equally spaced around the optical axis of the lamp housing.

In the lamp housing there are ventilations slots 30, and the diaphragm member has ventilation slots 32.

According to the invention a separate holder for each reflector is omitted because all reflectors are carried by the adjustable diaphragm member 16 having its periphery held stationary by means of the shoulder whereas its center is axially adjustable so that angular positions of the reflectors and thereby of the light beams may be adjusted simultaneously.

What is claimed:

1. Surgical operating room lamp comprising a lamp housing supporting at least three reflectors associated each with at least one bulb or similar lamp and being angularly adjustable to focus the light beams to a predetermined area along the central optical axis of the lamp housing, the reflectors being spaced equally around the optical axis, characterized in that the reflectors (24,26,28) and their bulbs are supported by a flexible diaphragm member (16) mounted in the lamp housing with its peripheral edge resting against a shoulder (14) or similar abutment; and that the diaphragm member is supported at its center by an axially adjustable control device (20,22) to displace the center of the diaphragm member away from the open end of the lamp housing to set those portions of the diaphragm member supporting the reflectors at the same angle to the optical axis thereby adjusting the angular position of all reflectors simultaneously.

2. Lamp according to claim 1, characterized in that the adjustable control device includes a nut member (18) and a screw (20) operable by means of a rotatable control member (22) located at the upper end of the lamp.

3. Lamp according to claim 1, characterized in that the diaphragm member is a flexible disc having its circular edge resting against the shoulder (14) provided on the inside of the lamp housing.

* * * * *